US012246232B2

(12) United States Patent
Rivard

(10) Patent No.: US 12,246,232 B2
(45) Date of Patent: Mar. 11, 2025

(54) METHOD AND APPARATUS FOR BAG THROWING GAME

(71) Applicant: Rivard Companies, Inc., East Bethel, MN (US)

(72) Inventor: Michael Rivard, Cedar, MN (US)

( * ) Notice: Subject to any disclaimer, the term of this patent is extended or adjusted under 35 U.S.C. 154(b) by 7 days.

(21) Appl. No.: 16/519,965

(22) Filed: Jul. 23, 2019

(65) Prior Publication Data

US 2020/0114235 A1 Apr. 16, 2020

Related U.S. Application Data

(63) Continuation of application No. 15/843,966, filed on Dec. 15, 2017, now abandoned, which is a continuation-in-part of application No. 29/610,922, filed on Jul. 17, 2017, now Pat. No. Des. 898,122.

(60) Provisional application No. 62/435,763, filed on Dec. 17, 2016.

(51) Int. Cl.

| | |
|---|---|
| ***A63B 67/06*** | (2006.01) |
| ***A63B 63/00*** | (2006.01) |
| ***A63B 71/06*** | (2006.01) |
| ***A63F 9/02*** | (2006.01) |
| ***A63F 11/00*** | (2006.01) |

(52) U.S. Cl.

CPC ..... *A63B 67/06* (2013.01); *A63B 63/00* (2013.01); *A63F 9/02* (2013.01); *A63B 71/0672* (2013.01); *A63B 2225/76* (2020.08); *A63F 2011/0055* (2013.01)

(58) Field of Classification Search

CPC ..... A63B 63/00; A63B 67/06

USPC ..... 273/402

See application file for complete search history.

(56) References Cited

U.S. PATENT DOCUMENTS

| | | | | |
|---|---|---|---|---|
| 731,192 | A | 6/1903 | Lewis | |
| 1,989,484 | A | 1/1935 | Maryfield et al. | |
| 3,165,317 | A | 1/1965 | Kirsch | |
| 3,178,227 | A | 4/1965 | Snyder | |
| 3,568,357 | A * | 3/1971 | Lebensfeld | A63F 3/00574 446/91 |
| D222,485 | S | 10/1971 | Grant | |
| 3,762,708 | A | 10/1973 | Hing | |
| 3,820,789 | A * | 6/1974 | Dudley | A63F 7/305 273/400 |
| 3,837,650 | A | 9/1974 | Haney | |
| 3,840,234 | A | 10/1974 | Felsten | |

(Continued)

OTHER PUBLICATIONS

U.S. Appl. No. 15/843,966, filed Dec. 15, 2017, Method and Apparatus for Bag Throwing Game.

(Continued)

*Primary Examiner* — Melba Bumgarner
*Assistant Examiner* — Amir A Klayman
(74) *Attorney, Agent, or Firm* — Schwegman Lundberg & Woessner, P.A.

(57) ABSTRACT

The present application describes a bag throwing game board and game. Players take a plurality of soft bags that are approximately round in shape and throw them from a distance towards the game board, which in various examples is in the shape of a tower, and has holes. Points are attributed to bags landing in different holes of the board, depending on the difficulty of landing the bag in each hole. After a series of throws, the point scores are totaled and the player earning the most points or the player first to reach a score goal wins.

20 Claims, 8 Drawing Sheets

(56) References Cited

U.S. PATENT DOCUMENTS 3,905,602 A 9/1975 Madonna, Jr. et al.
4,022,472 A 5/1977 Seals
4,120,499 A 10/1978 Stazzone
4,276,705 A 7/1981 Barth et al.
4,331,335 A 5/1982 Starkweather
D272,841 S 2/1984 Matsumoto
4,826,177 A 5/1989 Ponte
4,919,436 A * 4/1990 Buselli ..... A63F 9/0208 273/348.4
4,923,201 A 5/1990 Nichol et al.
4,927,160 A 5/1990 Nicol et al.
4,938,485 A 7/1990 Hockridge et al.
4,943,065 A 7/1990 Delapa
4,961,586 A 10/1990 Conville
4,986,549 A 1/1991 Kuhtic et al.
D315,186 S 3/1991 Peterson
5,050,889 A 9/1991 Walker
5,056,796 A 10/1991 Conville
5,165,695 A 11/1992 Yoder
D343,426 S 1/1994 Sher
D343,790 S 2/1994 Mermelstein
5,318,308 A 6/1994 Holms
5,320,360 A * 6/1994 St. Pierre ..... A63F 9/0204 273/402
5,332,230 A 7/1994 Benedict
D363,953 S 11/1995 Buse
5,516,114 A 5/1996 Michlin et al.
5,536,017 A * 7/1996 Salisian ..... A63F 9/0204 273/375
D392,185 S 3/1998 Husted
5,765,832 A 6/1998 Huff
5,871,216 A 2/1999 Sparacino
5,909,877 A 6/1999 Bour
6,244,598 B1 6/2001 Conville
6,554,724 B2 * 4/2003 Taylor ..... A63B 24/0021 273/317.3
D478,194 S 8/2003 Mcginty
6,843,478 B1 * 1/2005 Hoepelman ..... A63B 63/00 273/342
6,866,268 B2 * 3/2005 Christianson ..... A63B 65/10 273/398
D505,321 S 5/2005 Bechard
6,932,345 B1 8/2005 O'Dell
D515,683 S 2/2006 Lablaine
7,096,790 B1 8/2006 Wah
D544,041 S 6/2007 Murphy et al.
7,237,777 B2 7/2007 Digges, III et al.
7,314,420 B2 1/2008 Konstant
D592,410 S 5/2009 Pozin et al.
7,607,666 B1 10/2009 Studier
D604,977 S 12/2009 Conville
D616,728 S 6/2010 Bucci
7,802,795 B2 9/2010 Bos
7,854,528 B2 12/2010 Segretto et al.
D631,729 S 2/2011 Bucci
7,887,059 B2 2/2011 Kiernan
D635,010 S 3/2011 Bucci
D635,197 S 3/2011 Pryor
D642,447 S 8/2011 Bucci
D645,520 S 9/2011 Dahl
D649,435 S 11/2011 Bucci
D652,709 S 1/2012 Bucci
8,127,689 B2 3/2012 Christian et al.
8,157,265 B2 4/2012 Conville et al.
8,162,318 B1 4/2012 Peterson et al.
D660,685 S 5/2012 Bucci
D662,746 S 7/2012 Conville
D668,933 S 10/2012 Bucci
D669,760 S 10/2012 Bucci
D672,222 S 12/2012 Bucci
D673,027 S 12/2012 Wang
8,347,790 B1 1/2013 Maiers
8,444,150 B1 5/2013 Stirtz
8,657,293 B2 2/2014 Sindaco
D706,353 S 6/2014 Montenare
D706,354 S 6/2014 Montenare
D706,355 S 6/2014 Montenare
8,794,629 B1 8/2014 Humphreys
8,807,569 B1 8/2014 Davis
8,827,845 B1 9/2014 Griffin
D741,409 S 10/2015 Moulton
D741,951 S 10/2015 Angel
9,248,357 B2 2/2016 Francis
9,381,414 B1 7/2016 Gatton
9,550,101 B2 1/2017 Janeri
9,687,708 B2 6/2017 Bennett
9,687,709 B2 * 6/2017 Riniti ..... A63B 67/06
D835,614 S 12/2018 Kahn et al.
D837,092 S 1/2019 Yang
D848,595 S 5/2019 Nechita
D898,122 S 10/2020 Rivard
2002/0079645 A1 6/2002 Brown
2005/0023762 A1 2/2005 Greiwe et al.
2006/0038341 A1 2/2006 Konstant
2006/0125186 A1 6/2006 Digges, III et al.
2006/0255537 A1 11/2006 Gandley
2007/0080499 A1 4/2007 Greiwe et al.
2008/0157476 A1 7/2008 Striebel et al.
2008/0179833 A1 * 7/2008 Held ..... A63F 9/02 273/402
2009/0051133 A1 2/2009 Oshiro
2009/0062002 A1 3/2009 Kotlarik et al.
2009/0091926 A1 4/2009 Segretto et al.
2009/0115136 A1 5/2009 Voden
2009/0295093 A1 12/2009 Kiernan
2010/0058958 A1 3/2010 Christian et al.
2010/0140873 A1 6/2010 Britton et al.
2010/0164175 A1 7/2010 Buchanan
2010/0181726 A1 7/2010 Bos
2010/0194047 A1 * 8/2010 Sauerwine ..... A63B 67/06 273/400
2010/0295248 A1 11/2010 Krause et al.
2010/0320692 A1 12/2010 Tookey
2011/0193287 A1 8/2011 Hopkins et al.
2011/0215528 A1 9/2011 Conville et al.
2011/0261357 A1 12/2011 Boyle
2011/0291357 A1 12/2011 Boyle
2012/0038109 A1 2/2012 Battista
2012/0193873 A1 8/2012 Sindaco
2013/0026713 A1 1/2013 Angel
2013/0082442 A1 4/2013 Hanel
2013/0234394 A1 9/2013 Voden
2014/0015198 A1 1/2014 Francis
2014/0052646 A1 2/2014 Ross
2014/0091525 A1 4/2014 Ramirez
2014/0091526 A1 4/2014 Nally
2014/0151963 A1 6/2014 Bennett
2014/0183822 A1 7/2014 Etheridge
2014/0183823 A1 7/2014 Deming et al.
2014/0239594 A1 8/2014 Deloatch
2014/0333028 A2 11/2014 Nally
2015/0108719 A1 4/2015 Devine
2015/0115532 A1 4/2015 Martinson et al.
2015/0130135 A1 5/2015 Shalhoub
2015/0231467 A1 8/2015 Sciandra
2015/0265894 A1 9/2015 Weber et al.
2015/0328515 A1 11/2015 Prendergast
2016/0008689 A1 1/2016 Janeri
2016/0023095 A1 1/2016 Nally
2016/0065883 A1 3/2016 Hufman et al.
2016/0082334 A1 3/2016 Olive
2016/0089589 A1 3/2016 Ali et al.
2016/0192783 A1 7/2016 Kelly
2016/0256758 A1 9/2016 Riniti
2016/0325163 A1 11/2016 Tsai
2017/0056739 A1 3/2017 Jacobson et al.
2017/0095715 A1 4/2017 Maginnis
2017/0113112 A1 4/2017 Voss
2017/0138586 A1 5/2017 Finch et al.
2017/0173427 A1 6/2017 Wolters

(56) References Cited

U.S. PATENT DOCUMENTS

| | | | |
|---|---|---|---|
| 2017/0173428 | A1 | 6/2017 | Wolters |
| 2018/0207503 | A1 | 7/2018 | Rivard |

OTHER PUBLICATIONS

U.S. Appl. No. 29/610,922, filed Jul. 17, 2017, Throwing Game Board.
"U.S. Appl. No. 15/843,966, Final Office Action mailed Jan. 23, 2019", 7 pgs.
"U.S. Appl. No. 15/843,966, Non Final Office Action mailed Aug. 7, 2018", 8 pgs.
"U.S. Appl. No. 15/843,966, Response filed Jan. 4, 2019 to Non Final Office Action mailed Aug. 7, 2018", 8 pgs.
"U.S. Appl. No. 29/610,922, Ex Parte Quayle Action mailed Feb. 24, 2020", 4 pgs.
"U.S. Appl. No. 29/610,922, Non Final Office Action mailed May 9, 2019", 6 pgs.
"U.S. Appl. No. 29/610,922, Notice of Allowance mailed Jun. 4, 2020", 5 pgs.
"U.S. Appl. No. 29/610,922, Response filed May 19, 2020 to Ex Parte Quayle Action mailed Feb. 24, 2020", 3 pgs.
"U.S. Appl. No. 29/610,922, Response filed Nov. 12, 2019 to Non-Final Office Action mailed May 9, 2019", 3 pgs.
U.S. Appl. No. 29/610,922, Supplemental Notice of Allowability mailed Jul. 17, 2020, 2 pgs.

* cited by examiner

METHOD AND APPARATUS FOR BAG THROWING GAME

RELATED APPLICATIONS AND CLAIM OF PRIORITY

The present application is a continuation of and claims the benefit of priority under 35 U.S.C. § 120 to U.S. patent application Ser. No. 15/843,966, filed on Dec. 15, 2017, which claims the benefit of U.S. provisional patent application Ser. No. 62/435,763, filed Dec. 17, 2016, entitled Method and Apparatus for Bag Throwing Game, and as a continuation-in-part to U.S. design application Ser. No. 29/610,922, filed Jul. 17, 2017, entitled Throwing Game Board, each of which is incorporated by reference herein in its entirety.

TECHNICAL FIELD

The present application relates to a bag throwing game.

SUMMARY

The present application describes a bag throwing game. It describes how to make the game components and how to play the game. Players take a plurality of soft bags that are approximately round in shape and throw them from a distance towards the board, which is in the shape of a tower. Points are attributed to bags landing in different holes of the board, depending on the difficulty of landing the bag in each hole. After a series of throws, the point scores are totaled and the player earning the most points or the player first to reach a score goal wins.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

BRIEF DESCRIPTION OF THE DRAWINGS

These and other features, aspects, and advantages of the present disclosure are better understood when the following Detailed Description is read with reference to the accompanying drawings.

DETAILED DESCRIPTION

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

The present application describes a bag throwing game. It describes how to make the game components and how to play the game. Players take a plurality of soft bags that are approximately round in shape and throw them from a distance towards the board, which is in the shape of a tower. Points are attributed to bags landing in different holes of the board, depending on the difficulty of landing the bag in each hole. After a series of throws, the point scores are totaled and the player earning the most points or the player first to reach a score goal wins.

The present subject matter relates to a bag throwing game that can be played at a number of locations. For example, it can be played at home, in a gym, at the office, at a bar, at a restaurant, or other establishment. It includes a plurality of bags and a board with at least three holes that is mounted vertically (or substantially vertically). The players stand a distance from the board, which is mounted at about 3-4 feet from the floor level, and throw the bags, attempting to have them land within the holes of the board. Higher point values are attributed to players who successfully throw a bag into the holes that have a smaller opening (e.g., smaller cross section). The bags will vary in size and in filling material. In various embodiments, the bags are about 6-8 oz. and are roughly round in shape and have dimensions approximating 4.25" to 4.5" in diameter. Various filling material may be used in the bags, such as sand, pebbles, beans, rice, or other filling material.

Figure 1:
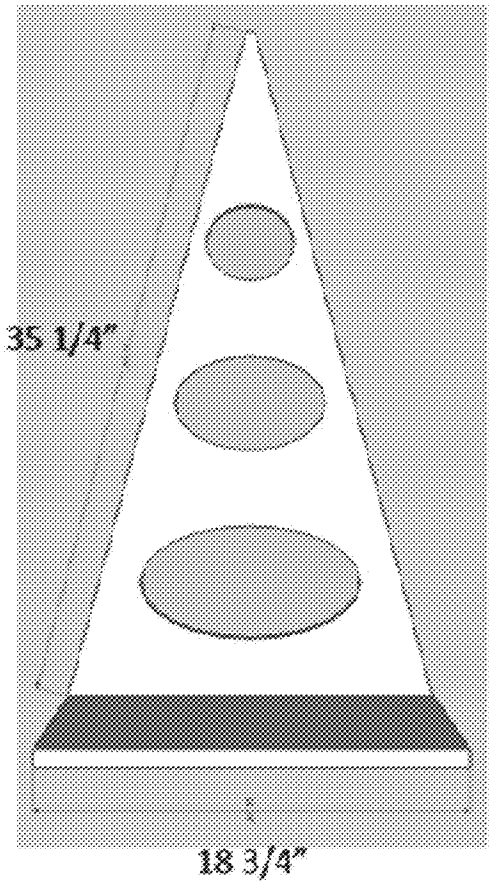
FIG. 1 shows a front drawing view of an example of a game board according to one embodiment of the present subject matter.

The tower-shaped game board can be made of any rigid material, such as wood, plastic, metal, or combinations thereof. The dimensions in each of the drawings may vary without departing from the scope of the present subject matter. FIG. 1 shows a front drawing view of an example of a game board according to one embodiment of the present subject matter. In this example, the tower has a shelf which is roughly 19"×13" and may be rectangular in shape. Different shelf sizes may be used without departing from the scope of the present subject matter. The upper portion of the tower is roughly 3 feet in height and contains at least 3 holes of different sizes. In various embodiments, more than 3 holes are used. In various embodiments, the holes can be of different sizes. In various embodiments, the holes can be of the same size with more in certain areas of the board to provide more opportunities for the bag to be thrown into the hole. The hole sizes can vary from just above the size of the bags used to holes that are multiples of the bag size.

Figure 2:
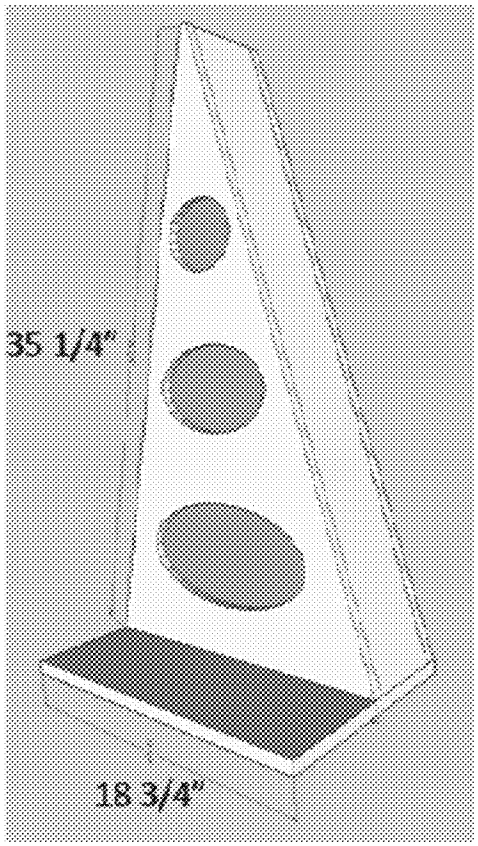
FIG. 2 shows a perspective drawing view of an example of a game board according to one embodiment of the present subject matter.

In the example of FIG. 1, the holes are progressively smaller toward the top of the tower design; however, it is possible that more holes may be employed, and that they need not be progressively changing in size as demonstrated. Furthermore, in various embodiments the holes may be staggered or grouped differently, as desired. Therefore, the hole patterns shown here are exemplary and not intended to be exclusive or limiting the board design. Typically point values are higher for holes that are more difficult to successfully receive the player's bag. FIG. 2 shows a perspective drawing view of an example of a game board according to one embodiment of the present subject matter. Each hole of the board may include an internal shelf that holds the bag if it enters the hole. The internal shelf material can be wood, plastic, metal or cloth. In various embodiments each internal shelf can be rigid or flexible.

Figure 3:
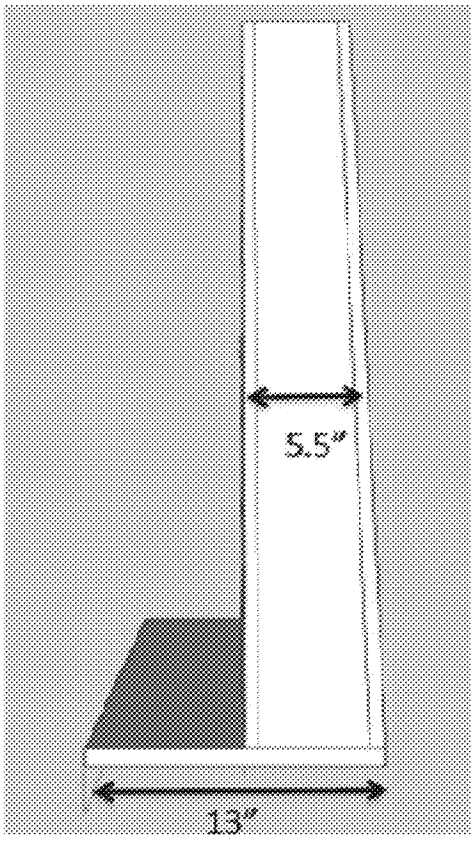
FIG. 3 shows a side drawing view of an example of a game board according to one embodiment of the present subject matter.

FIG. 3 shows a side drawing view of an example of a game board according to one embodiment of the present subject matter. In the drawing the depth of the tower is roughly 6 inches, but other depths may be employed without departing from the scope of the present subject matter. Furthermore, in various embodiments, the depth may vary across the height or width of both of the tower. Therefore, the present design is exemplary and not intended to be exhaustive or limiting.

Figure 4:
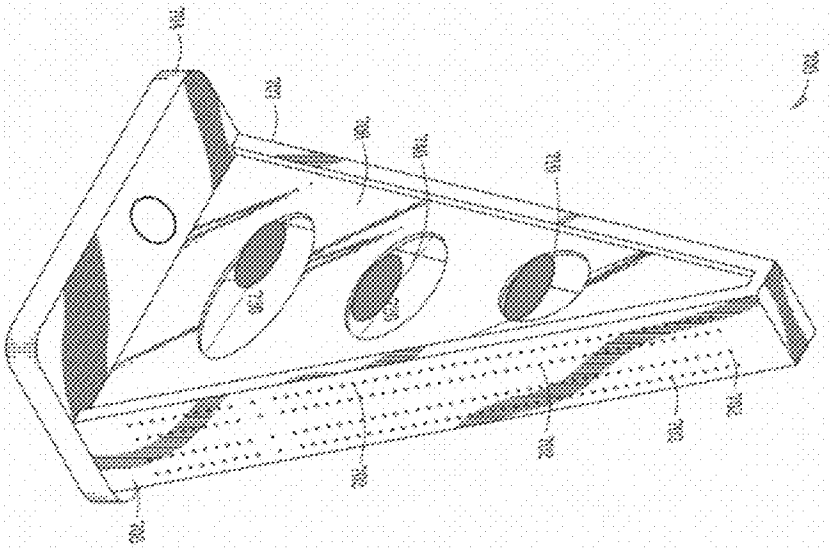
FIG. 4 shows a front perspective drawing of an example of a game board according to one embodiment of the present subject matter.

FIG. 4 shows a front perspective drawing of an example of a game board according to one embodiment of the present subject matter. Bags landing in the bottom hole are given a single point value. Those landing in the middle hole are given two points, and those landing in the top hole are three points. Point values can change, and points may be given to players whose bags land on the ledge, which extends to roughly 7 to 8 inches.

Figure 5:
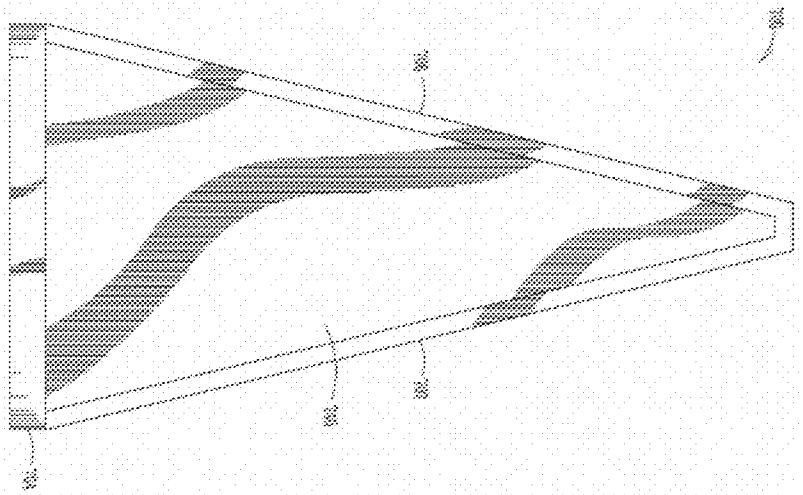
FIG. 5 shows a rear perspective drawing of an example of a game board according to one embodiment of the present subject matter.

FIG. 5 shows a rear perspective drawing of an example of a game board according to one embodiment of the present subject matter. Various mounting approaches may be employed. In various embodiments, the tower is mounted to a wall. One way that can be accomplished is with a French cleat. Other brackets, wires and connectors may be used. Other mounting approaches may be used, including but not limited to pedestals, table top mounts, or dedicated stands. Other mounting hardware and approaches may be employed without departing from the scope of the present subject matter.

Figure 6:
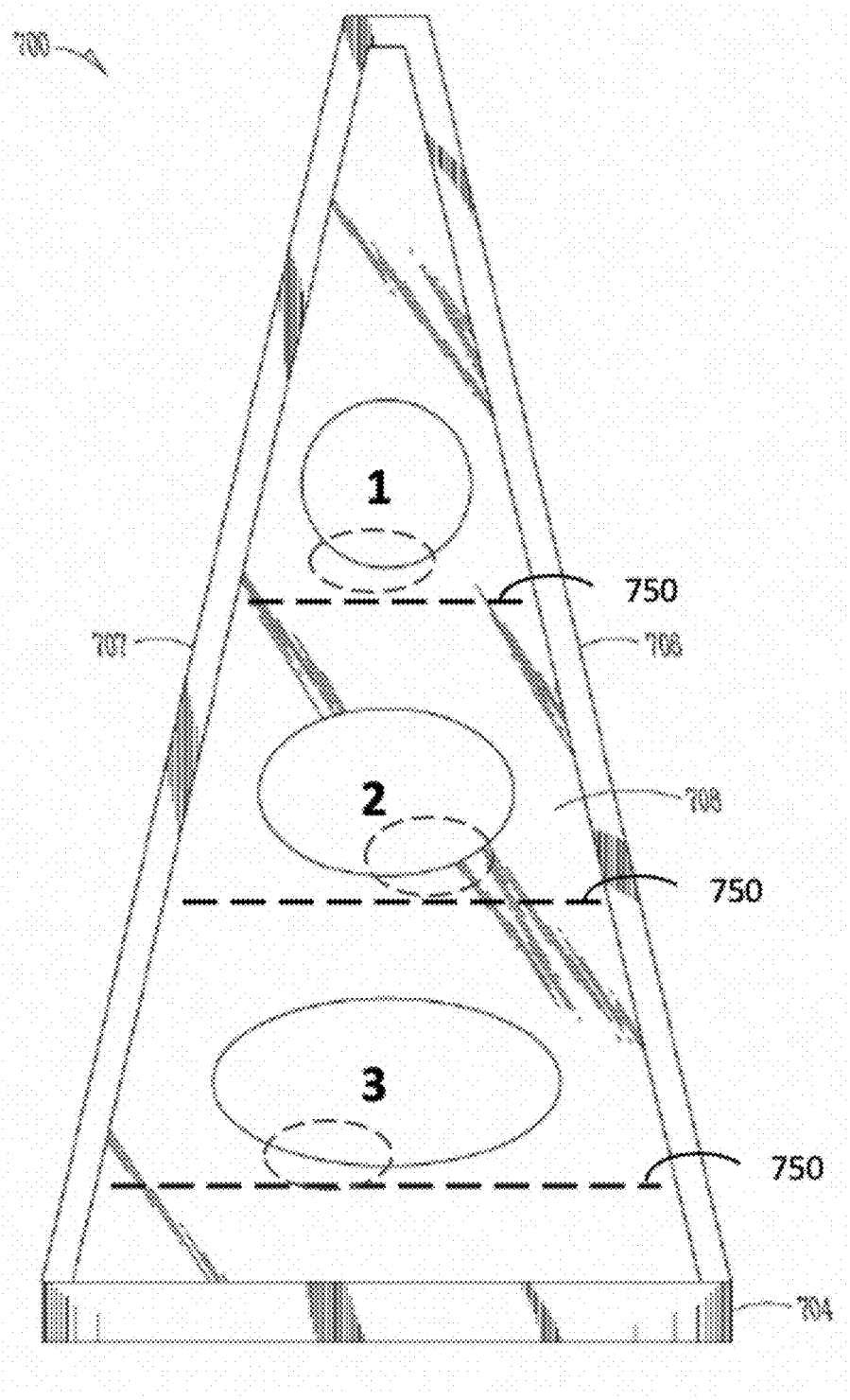
FIG. 6 shows a front drawing of an example of a game board according to one embodiment of the present subject matter.

FIG. 6 shows a front drawing of an example of a game board according to one embodiment of the present subject matter. The bags in each hole are shown resting on an internal shelf for each hole. The drawing shows dotted lines 750 for each internal shelf and dotted lines to show bags resting on each internal shelf. The sides of the tower are perforated to receive scoring pins so that the players can record their score as the game progresses. In various embodiments, there are four sets of holes on each side of the board and eight colored pegs allowing eight players to record their scores and to play at one time. The front face can be labeled to make scoring easier and to tally the scores. Therefore, markings and holes can be aligned for easy scoring and positioning of markers and pegs of a variety of shapes and sizes. Other types of scoring may be employed, including other counters, electronic scoring, and the like.

The game may be played using a variety of scoring methodologies. In one example, the players stand behind a line and each player throws all four bags consecutively trying to achieve as many points as possible, with a race to get to 22. In some variations of the game, if the scorer exceeds the score goal, that scorer may be penalized. For example, in the case where the scoring goal is 22 points, a player who exceeds the 22 score may have her score reduced to 15, for example, to attempt again to reach 22. In various embodiments, the players throw behind a line 6 feet away from the board. Other distances include 3, 4, 5, 7, 8, 9, 10, 11, 12 feet. Different distances may be employed without departing from the scope of the present subject matter. Other point goals, scoring methodologies, numbers of bags, and scoring concepts may be employed without departing from the present subject matter.

In one example, the game is played where each player starts at zero. The point scoring is 3 for the top smallest hole. 2 for the center oval, one for the bottom oval, zero for the shelf, and negative one for the floor. If a player gets to negative 7 it is an automatic loss and that player is eliminated. The first player to get to 22 is an automatic win. If a player goes over 22 they are put back to 16. Other scoring and playing approaches may be employed without departing from the scope of the present subject matter.

In various embodiments, there are four sets of holes on each side of the board and eight colored pegs allowing eight players to record their scores and to play at one time. In various embodiments, the front panel may use a dry erase or chalk board material to allow for marking of the holes, player names, scoring, or other uses. In various embodiments, a clear plastic front is used. In various embodiments, a front panel with lights is employed. In various embodiments, lights may be activated each time a score is successful, failed, or may signify both. Automatic scoring apparatus may be added to sense when points are scored and to add them to a visual counter. The counter may be digits, or it may be lights in a progression or pattern, such as lights extending to the top of the design. One set of lights progresses up the tower until the winner lights the light at the summit or peak of the tower. In various embodiments, the bags themselves may be lit to allow throwing them in the dark. Different forms of lighting the bags include light emitting diodes, glow in the dark, or blacklighting may be employed to add excitement to the game. The tower may also act as a nightlight and be illuminated as such. Other forms of scoring and illuminating the design may be employed without departing from the scope of the present subject matter.

Since the board is vertically mounted, it may be necessary for players to use more forward velocity on bag throws than what is used in other throwing games, such as horseshoes. Players may find it advantageous to throw the bags substantially horizontally to increase the chance that the bag will enter the openings of the board. This aspect increases the excitement of the game as it requires accuracy for each player to successfully land a bag in a hole of the board.

Figure 7:
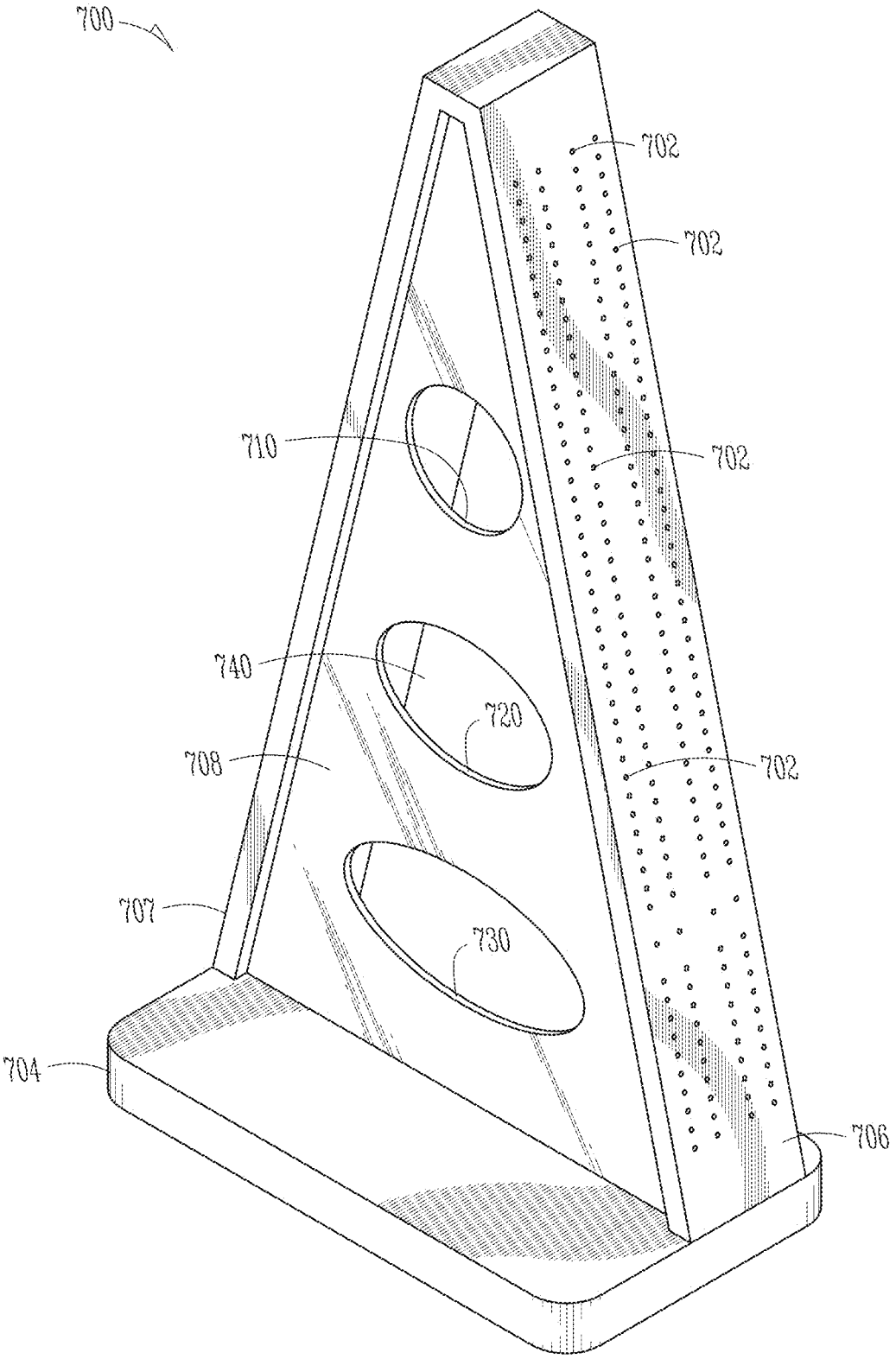
FIG. 7 shows a detailed perspective drawing view of an example of a game board according to one embodiment of the present subject matter.

FIG. 7 shows a detailed perspective drawing view of an example of a game board according to one embodiment of the present subject matter. Game board 700 includes a frame having a base 704 and sides 706, 707 that can include scoring peg holes 702 for tracking score with pegs or lights. A player can score points by throwing a bag into holes 710, 720, and 730. The number of holes and sizes can vary. Front panel 708 can be transparent or may have designs on it. In various embodiments, the front panel 708 is clear so that design on the back panel 740 can be viewed from the front.

Figure 8:
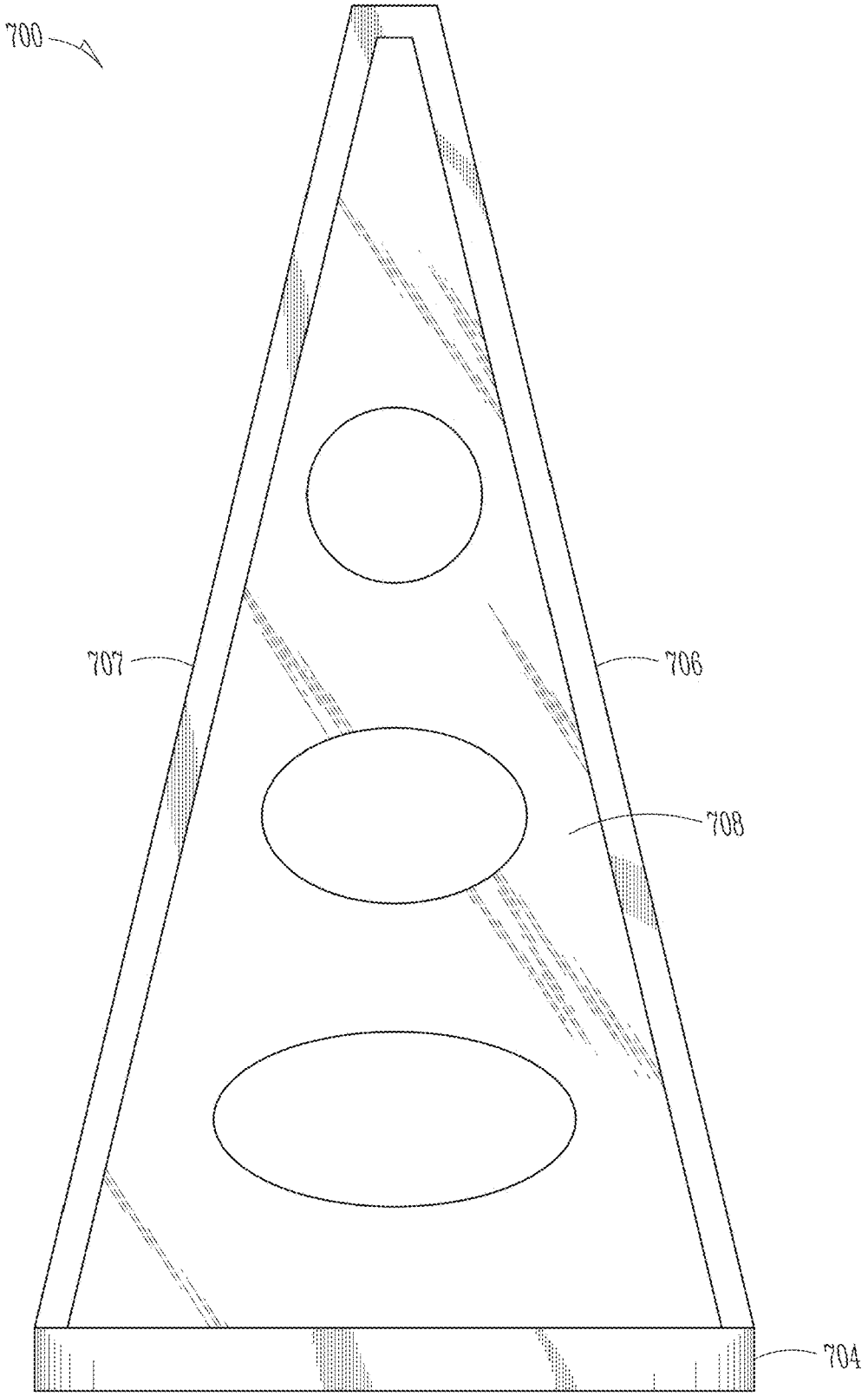
FIG. 8 shows a detailed front drawing view of an example of a game board according to one embodiment of the present subject matter.

FIG. 8 shows a detailed front drawing view of an example of the game board 700 according to one embodiment of the present subject matter.

Figure 9:
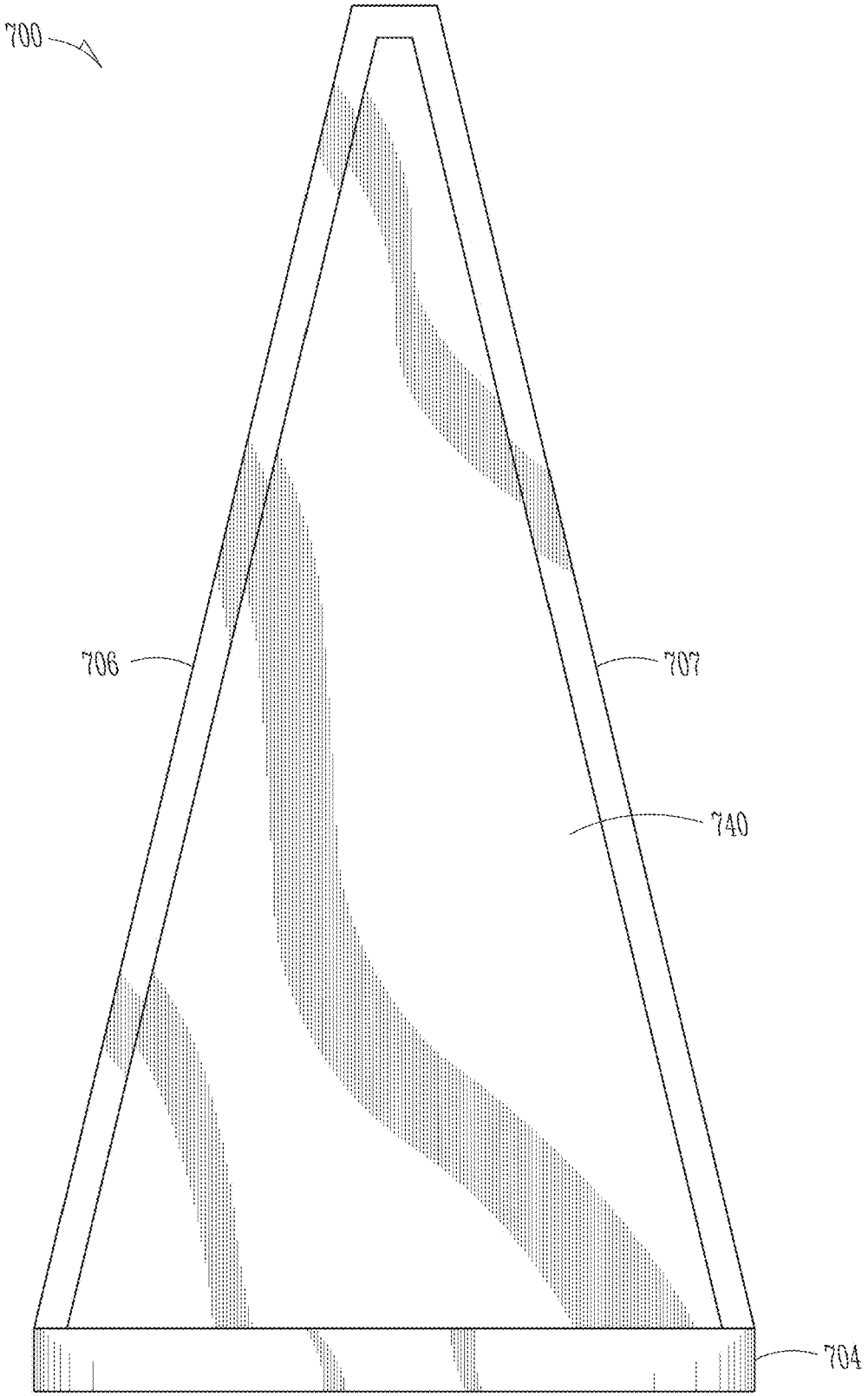
FIG. 9 shows a detailed rear view of an example of a game board according to one embodiment of the present subject matter.
Figure 10:
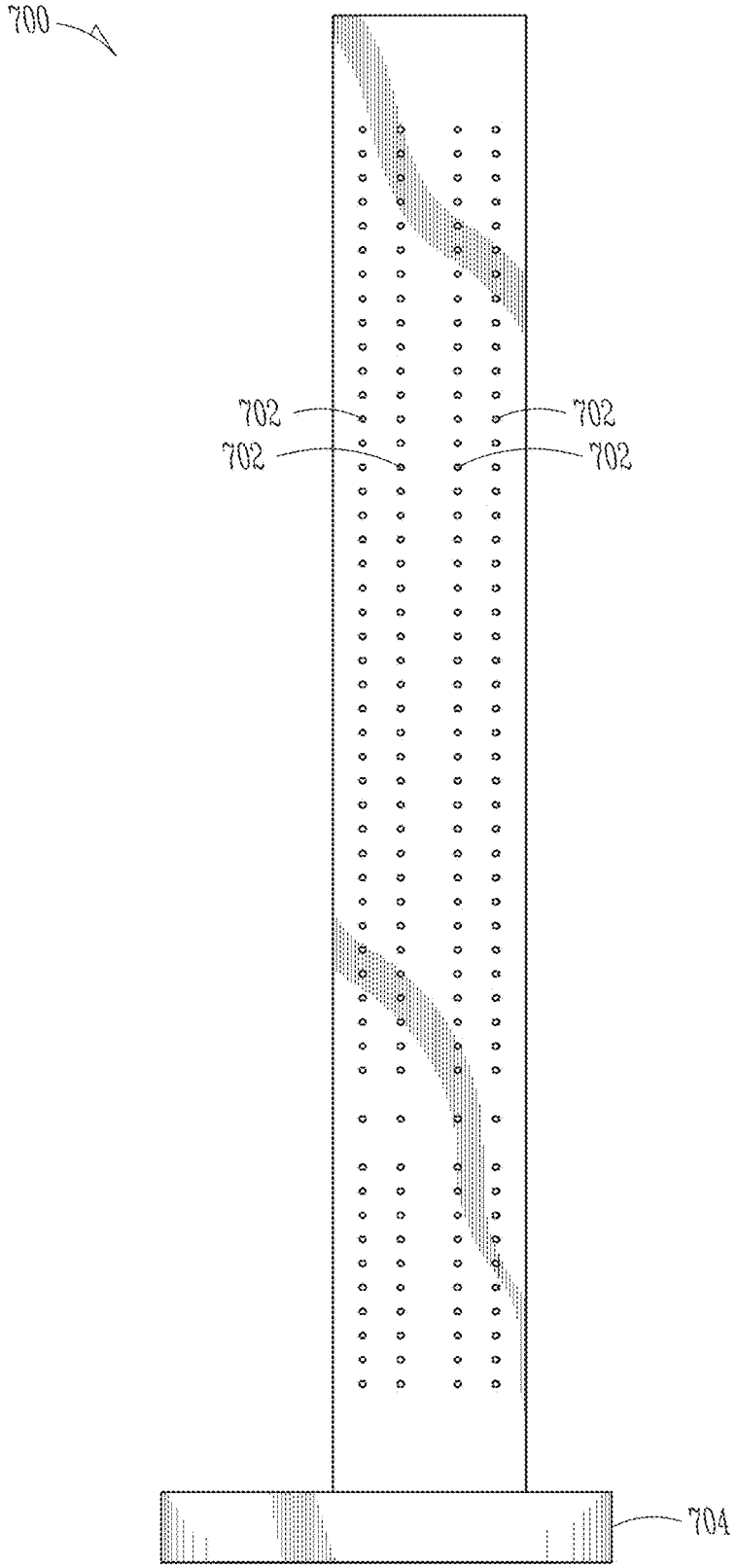
FIGS. 10 and 11 show detailed side drawings of an example of a game board according to one embodiment of the present subject matter.
Figure 11:
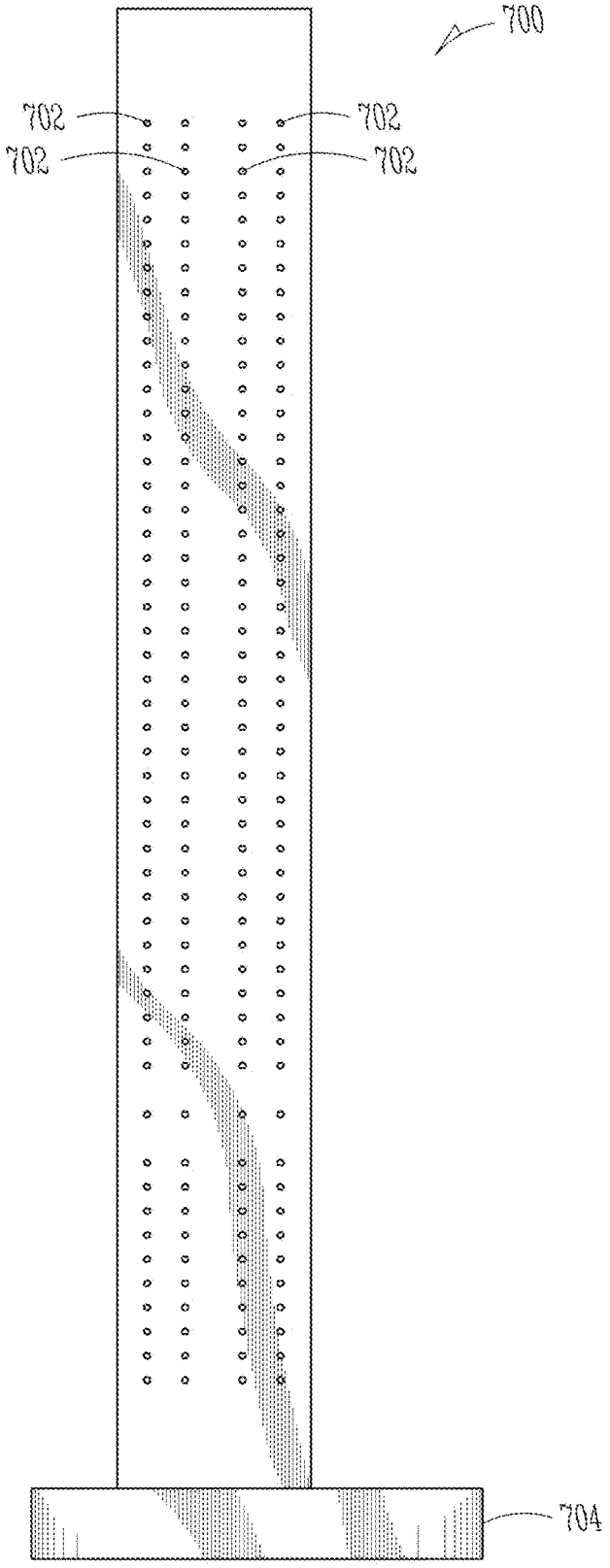

FIG. 9 shows a detailed rear view of an example of a game board 700 with back panel 740 according to one embodiment of the present subject matter. FIGS. 10 and 11 show detailed side drawing views of an example of the game board 700 with scoring peg holes 702 according to one embodiment of the present subject matter.

In various embodiments, scoring is kept using pegs that glow in the dark and can be advanced along the sides of the game board as the players score. In various embodiments, the holes in which the pegs are placed are configured to receive light from inside of the game board. In various embodiments, scoring pegs are configured to receive light and light up the remaining portion of the peg so as to make it easier to see the scoring by the players. This is especially helpful in low lighting situations such as bars and restaurants and recreation rooms where such games may be found. In various embodiments, pegs such as those used in LITE-BRITE™ games may be used because the peg will receive light at one end and glow at the other end to better indicate score as the pegs are advanced on the board. In various embodiments, the peg holes for the board are drilled through. In various embodiments, the peg holes are translucent to allow light from the game board to illuminate a plastic peg, such as the pegs described herein. In various embodiments, the back panel of the board can be replaced with advertising to allow the game board to be used as advertising. In various embodiments, the back of the game board is designed to receive new signage or advertising so that the game can be configured for different themes. This way a game board can be made which receives the advertisement or other signage or decorative design desired.

The present application provides several examples, including but not limited to, a game comprising a plurality of bags and a substantially vertically mounted game board with a plurality of apertures defined by a front panel of the game board, a back panel, the game board comprising a plurality of shelves between the front panel and back panel to provide different compartments, and a bottom shelf of the game board for mounting and to catch bags that fail to enter the hole. A game of example 1, wherein the front panel of the game board is clear. A game of the prior examples wherein the game board includes lighting for illumination. A game of the prior examples, wherein the game board includes lighting for illumination. A game of the prior examples including advertising on the back panel. A game of the prior examples further comprising holes along the sides of the board to allow for scoring pegs. A game of any of the previous examples, wherein the holes allow lighting from the game to illuminate pegs placed in the holes. A game of the prior examples, further comprising holes along the sides of the board to allow for scoring pegs. A game of the prior examples, wherein the holes allow lighting from the game to illuminate pegs placed in the holes.

Another example is a substantially vertically mounted game board comprising a plurality of circular or round apertures defined by a front panel of the game board, a back panel, side panels attached to a base and the front panel and back panel, the game board further comprising a plurality of shelves to provide different compartments, wherein the base of the game board extends forward of the plane of the front panel to catch bags that fail to enter the holes. The game board of the prior example, further comprising peg holes for receiving pegs. The game board of the prior examples, further comprising lighting. The game board of the prior examples, wherein the lighting is configured to provide light to the peg holes so as to illuminate the board and pegs placed in the holes.

Other examples are provided herein, and those set forth are not intended in an exhaustive or exclusive sense.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

The invention claimed is:

1. A game comprising a plurality of bags and a substantially vertically mounted game board, the game board including a plurality of apertures defined by a front panel of the game board, a back panel, and sides, the game board comprising a plurality of internal shelves between the front panel, the sides, and the back panel to provide different compartments, and a bottom shelf of the game board to catch bags that fail to enter the apertures, wherein the substantially vertically mounted game board is configured such that bags entering an aperture may be captured on an internal shelf associated with the aperture to score game points, wherein the internal shelf is positioned lower than the aperture in the front panel to provide an edge to retain a bag on the internal shelf so that a bag that rebounds off of the back panel of the substantially vertically mounted game board is retained in a compartment associated with the aperture.

2. The game of claim 1, wherein the front panel of the game board is clear.

3. The game of claim 1, wherein the game board includes lighting for illumination.

4. The game of claim 2, wherein the game board includes lighting for illumination.

5. The game of claim 2, including advertising on the back panel.

6. The game of claim 4, including advertising on the back panel.

7. The game of claim 1, further comprising holes along the sides of the board to receive scoring pegs.

8. The game of claim 7, wherein the holes allow lighting from the game to illuminate pegs placed in the holes.

9. The game of claim 2, further comprising holes along the sides of the board to receive scoring pegs.

10. The game of claim 9, wherein the holes allow lighting from the game to illuminate pegs placed in the holes.

11. The game of claim 3, further comprising holes along the sides of the board to receive scoring pegs.

12. The game of claim 11, wherein the holes allow lighting from the game to illuminate pegs placed in the holes.

13. The game of claim 4, further comprising holes along the sides of the board to receive scoring pegs.

14. The game of claim 13, wherein the holes allow lighting from the game to illuminate pegs placed in the holes.

15. The game of claim 6, further comprising holes along the sides of the board to receive scoring pegs.

16. The game of claim 15, wherein the holes allow lighting from the game to illuminate pegs placed in the holes.

17. A substantially vertically mounted game board comprising a plurality of circular or round apertures defined by a front panel of the game board, a back panel, side panels attached to a base and the front panel and back panel, the game board further comprising a plurality of internal shelves to provide different compartments, wherein the base of the game board extends forward of a plane of the front panel to catch bags that fail to enter the apertures, wherein the substantially vertically mounted game board is configured such that bags entering an aperture may be captured on an internal shelf associated with the aperture to score game points, wherein the internal shelf is positioned lower than the aperture in the front panel to provide an edge to retain a bag on the internal shelf so that a bag that rebounds off of the back panel of the substantially vertically mounted game board is retained in a compartment associated with the aperture.

18. The game board of claim 17, further comprising peg holes for receiving pegs.

19. The game board of claim 18, further comprising lighting.

20. The game board of claim 19, wherein the lighting is configured to provide light to the peg holes so as to illuminate the board and pegs placed in the holes.

* * * * *